United States Patent [19]

Schrader

[11] 4,367,782

[45] Jan. 11, 1983

[54] METHOD AND APPARATUS FOR USE IN MOLDING ARTICLES

[75] Inventor: Gustav E. Schrader, Pepper Pike, Ohio

[73] Assignee: TRW Inc., Cleveland, Ohio

[21] Appl. No.: 691,217

[22] Filed: Jun. 1, 1976

[51] Int. Cl.[3] ..... B22D 17/22

[52] U.S. Cl. ..... 164/137; 164/27; 164/129; 164/130; 164/350; 164/364

[58] Field of Search ..... 164/19–27, 164/119, 129, 137, 309, 339, 350, 364, 6, 9, 15, 29, 165, 361, 130; 29/460, 461; 156/224, 242, 280; 427/430 R, 430 B; 264/219, 225, 263, 328; 249/126

[56] References Cited

U.S. PATENT DOCUMENTS

| | | | |
|---|---|---|---|
| 2,756,473 | 7/1956 | Anderson et al. | 164/339 |
| 2,975,482 | 3/1961 | Babcock | 264/263 X |
| 3,136,011 | 6/1964 | Peras | 106/38.27 |
| 3,628,598 | 12/1971 | MacNeill | 164/119 X |
| 3,669,177 | 6/1972 | Ingalls et al. | 164/129 X |
| 3,848,654 | 11/1974 | Boyle et al. | 164/137 X |
| 4,043,378 | 8/1977 | Pennington | 164/361 X |

*Primary Examiner*—Gus T. Hampilos
*Attorney, Agent, or Firm*—Yount & Tarolli

[57] ABSTRACT

An improved method is utilized to make an improved mold for forming a plurality of small objects, such as piston rings. The mold is made by stacking a plurality of mold sections formed of gas permeable material, such as $CO_2$ sand, resin bonded sand or green sand. The stacked mold sections are then clamped together to hold them against movement relative to each other. A wet coating of liquid ceramic material is then applied over the stack of mold sections. This liquid ceramic mold material is dried to form a rigid gas permeable ceramic casing which encloses the stack of mold sections. The rigid casing of ceramic material holds the mold sections against movement relative to each other to prevent break-out of metal from between the mold sections when a flow of molten metal is directed into the mold cavities. Due to the gas permeable construction of both the rigid ceramic casing and the mold sections, gas can readily escape from the mold as the molten metal enters the mold cavities.

28 Claims, 7 Drawing Figures

METHOD AND APPARATUS FOR USE IN MOLDING ARTICLES

BACKGROUND OF THE INVENTION

This invention relates to an improved method of making an improved mold by forming a rigid ceramic casing around a plurality of mold sections to hold them against movement relative to each other during a casting operation. The mold is advantageously utilized to form a plurality of relatively small articles.

A method and apparatus for casting a plurality of relatively small articles is disclosed in U.S. Pat. No. 3,786,857. This patent discloses a mold formed by a plurality of discs arranged in a stack. Each of the mold discs cooperates with an adjacent disc to define at least one mold cavity. The stack of mold discs is immersed in a body of molten metal. Molten metal flows inwardly through openings in the outside of the stack to the mold cavities within the stack. Since the stack of mold discs is unenclosed, difficulty could be encountered with molten metal flowing between the various mold discs if the molten metal was forced into the mold cavities under pressure.

It has been proposed to enclose a plurality of mold discs with a metal casing to support the mold discs in the manner disclosed in U.S. Pat. No. 1,358,435. Although the metal casing does, to some extent at least, support the mold discs, it blocks the escape of gas from the mold cavities. To accommodate the escape of gas from the mold, paper sheets are placed between each of the mold discs and are burned as molten metal is poured into the mold. Of course, burning the paper sheets between the discs provides a space between the mold discs which may fill with molten metal to provide objectionable flash or run-out during a casting operation.

In addition to the aforementioned patents, U.S. Pat. Nos. 3,628,598 and 3,656,539 disclose the use of a stack of mold sections to form a plurality of parts. These patents contemplate that the molten metal will be forced into the mold cavities by the use of a fluid pressure differential.

SUMMARY OF THE PRESENT INVENTION

The present invention provides a new and improved mold which is formed by a new and improved method which includes applying a wet coating of liquid ceramic material over a plurality of mold sections. The wet coating of liquid ceramic material is dried to form a rigid casing which encloses the mold sections. This rigid ceramic casing holds the mold sections against movement relative to each other during a molding operation in which molten metal is directed into one or more cavities defined by the mold sections.

Since the wet coating of liquid ceramic material will conform to the configuration of the outside surfaces of the mold sections, the dimensions of the mold sections can vary due to manufacturing tolerances. Even if both the width and thickness of the mold sections vary somewhat relative to each other, the wet coating of ceramic mold material will conform to the outside configuration of the mold sections so that the resulting rigid ceramic casing will hold the mold sections in tight sealing engagement with each other to prevent a break-out of metal between the mold sections during a casting operation. The rigid ceramic casing and the mold sections are both gas permeable. This enables gas to readily escape from the mold during a casting operation.

Prior to being covered with a ceramic material, each mold section is placed on a stack in the proper orientation, suction is then applied to the stack of mold section to remove any loose sand or other foreign particles. Each mold section is cleaned in turn by the application of suction to the stack each time a mold section is added to the stack.

The mold sections are then clamped together in a stack with a controlled force by means of a pair of clamp members disposed at opposite ends of the stack. The clamp members are interconnected by a rod which extends through a passage formed in the stack. This clamping arrangement holds the mold sections against movement relative to each other during the application of the coating of liquid ceramic material to the mold sections and during the subsequent drying of the coating. After the coating has been dried, the clamp member extending through the central passage in the mold sections is withdrawn to provide an open passage for metal to flow into the mold. Although it is contemplated that a flow of metal may be induced into the mold in many different ways, the metal is advantageously forced into the mold under the influence of a fluid pressure differential.

Accordingly, it is an object of this invention to provide a new and improved method of making a new and improved mold which is formed by applying a wet coating of ceramic material over a plurality of mold sections and then drying the coating to form a rigid ceramic casing which holds the mold sections against movement relative to each other during a casting operation.

Another object of this invention is to provide a new and improved method and mold as set forth in the next preceding object and wherein the mold sections and rigid ceramic casing are formed of gas permeable material to facilitate the escape of gas from the mold during a casting operation.

Another object of this invention is to provide a new and improved method and mold as set forth in the preceding objects and wherein the rigid ceramic casing applies a clamping force to the mold sections urging them together to prevent a break-out of metal between the mold sections during a casting operation.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Although a mold constructed in accordance with the present invention can be utilized to cast many different types of articles, the mold is advantageously utilized to cast a piston ring 10 which has an annular configuration and is formed of a high alloy steel. The piston ring 10 has a diameter of approximately three inches and a square cross sectional configuration with one eighth inch sides. Since the construction of piston rings similar to the piston ring 10 is well known, it will not be further described herein to avoid prolixity of description. It should be understood that the foregoing dimensions of the piston ring 10 are set forth for purposes of clarity of understanding and that piston rings of different sizes and objects other than piston rings can be cast with an improved mold constructed in accordance with the present invention.

Figure 2:
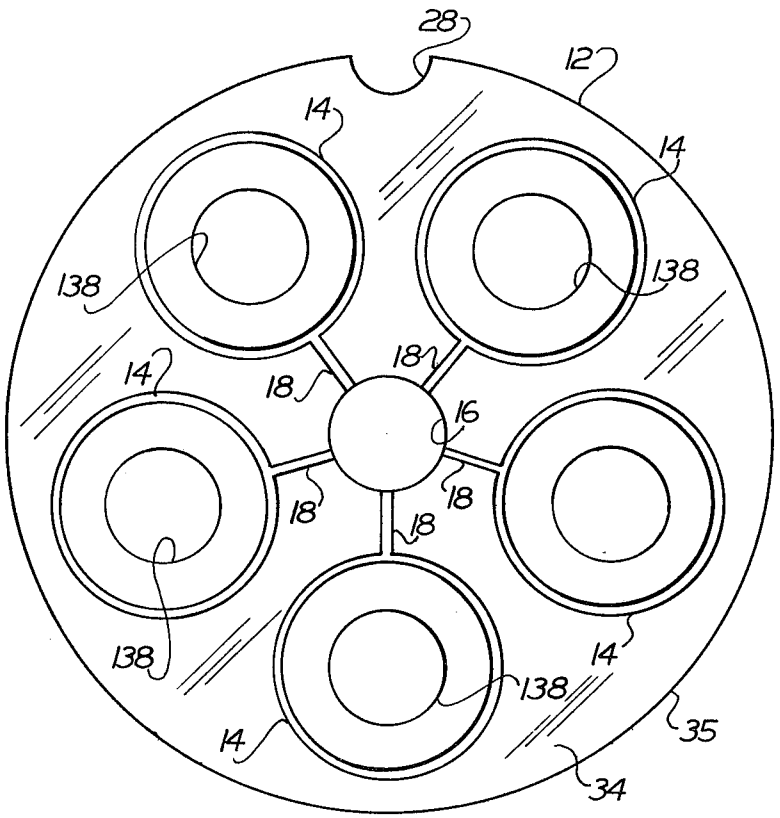
FIG. 2 is a plan view of a mold section having surfaces which partially define a plurality of mold cavities for forming a plurality of the piston rings of FIG. 1.
Figure 1:
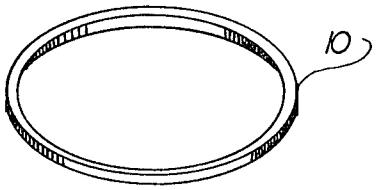
FIG. 1 is an illustration of an article, in the present instance a piston ring, formed in a mold constructed in accordance with the present invention.

A mold section 12 (see FIG. 2) is utilized to partially define a plurality of mold cavities in which piston rings 10 are formed. Thus, the mold section 12 is provided with a plurality of annular mold cavities 14. Although five mold cavities 14 have been illustrated in FIG. 2, it should be understood that either a greater or lesser number of mold cavities could be provided in a mold section if desired.

Figure 3:
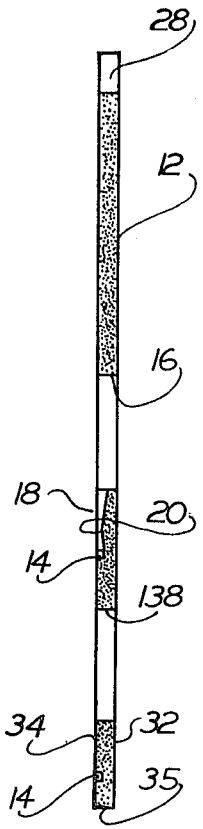
FIG. 3 is a sectional view, taken generally along the line 3—3 of FIG. 2, illustrating the relationship between a mold cavity and a central passage or sprue and runner through which metal flows into the mold cavity.

The mold cavities 14 are disposed in a circular array about a sprue or central passage 16 extending through the mold section 12. The sprue passage 16 is connected with the mold cavities 14 by a plurality of radially extending runners 18. Each of the runners 18 is provided with a choke section 20 (FIG. 3) of a reduced cross sectional area to at least partially control the flow of metal from the central sprue passage 16 to the associated mold cavity 14 during a casting operation.

Figure 4:
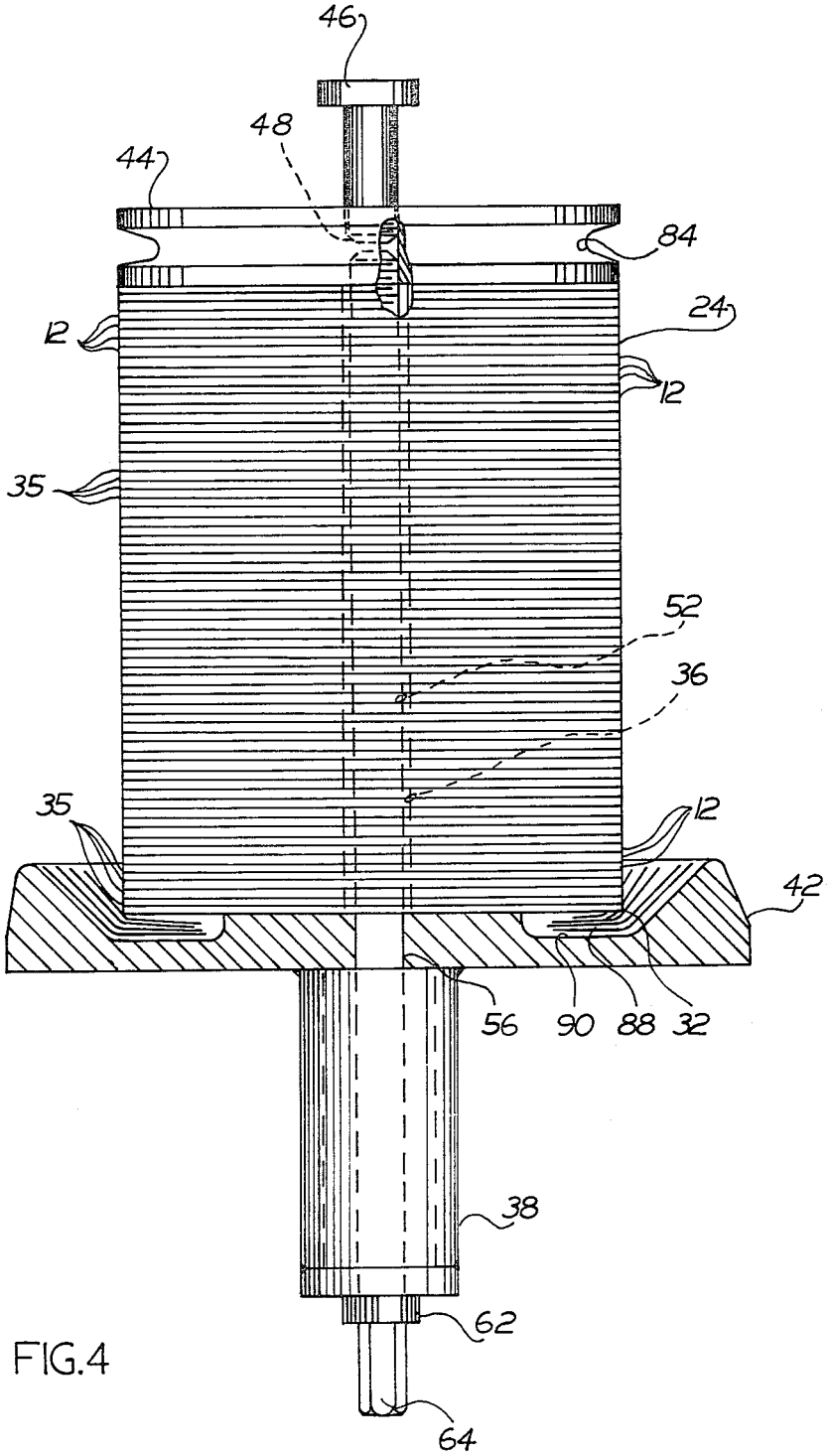
FIG. 4 is a partially broken-away view, on a reduced scale, illustrating the relationship of a clamp assembly to a stack of the mold sections of FIG. 2.

The circular mold sections 12 are arranged in a cylindrical stack 24 (see FIG. 4). The mold sections 12 are advantageously stacked in vertical alignment with each other on a jig (not shown) having a flat base and a semicircular upstanding wall of a diameter corresponding to the diameter of the mold sections 12. A locating rod is provided in association with the wall to engage a notch 28 (see FIG. 2) formed in each of the mold sections 12 to locate the mold sections in the proper rotational orientation with each other to provide for vertical venting.

The mold sections are stacked with a flat major side surface 32 (FIG. 2) of each of the mold sections facing downwardly and an opposing major side surface 34 facing upeardly. The upwardly facing major side surface 34 of one of the mold sections 12 engages the bottom surface 32 of the mold section directly above it to close off the mold cavities 14. Minor side surfaces 35 of the stacked mold sections are exposed to define the outside of the stack 24. It should be noted that the circular central sprue passages 16 in each of the mold sections are disposed in vertical alignment to form a continuous cylindrical sprue passage 36 through the stack 24 of mold sections. After each mold section has been stacked in this manner, the stack of mold sections is enclosed by a hood which automatically moves into position and applies suction to remove loose particles from the stack of mold sections. This is automatically repeated for each mold section added to the stack.

The stack 24 of mold sections is then disposed on a combination clamping and support assembly 38 (see FIG. 4). The clamping and support assembly 38 includes a circular base clamp plate 42 upon which the stack 24 of mold sections is supported. A circular top clamp plate 44 is disposed on top of the stack 24 of mold sections 12. A handling stem 46 is received in a threaded opening 48 formed in the top clamp plate 44. It should be noted that the flat bottom surface of the top clamp plate 44 cooperates with the uppermost mold section 12 in the stack 24 to complete the mold cavities 14.

In order to provide a clamping force urging the two plates 42 and 44 together, a rod 52 extends upwardly through the cylindrical sprue passage 36 formed by the openings 16 in the mold sections 12. The upper end of the rod 52 is disposed in threaded engagement with the opening 48 in the top clamp plate 44. The rod 52 extends downwardly through a cylindrical opening 56 formed in the bottom clamp plate 42 and a spacer 58 which is connected to the bottom clamp plate. A circular collar 62 is fixedly connected to the rod 52 engages an end wall of the spacer 58.

The lowermost end portion 64 of the rod 52 is provided with a suitable cross sectional configuration to enable the rod to be engaged by a wrench to rotate the rod. Of course, as the rod 52 is rotated the interaction between the threaded opening 48, the threaded upper end of the rod, the collar 62 and the spacer 58 urges the clamp plates 42 and 44 toward each other. This securely clamps the stack 24 of mold sections between the bottom clamp plate 42 and the top clamp plate 44.

Figure 5:
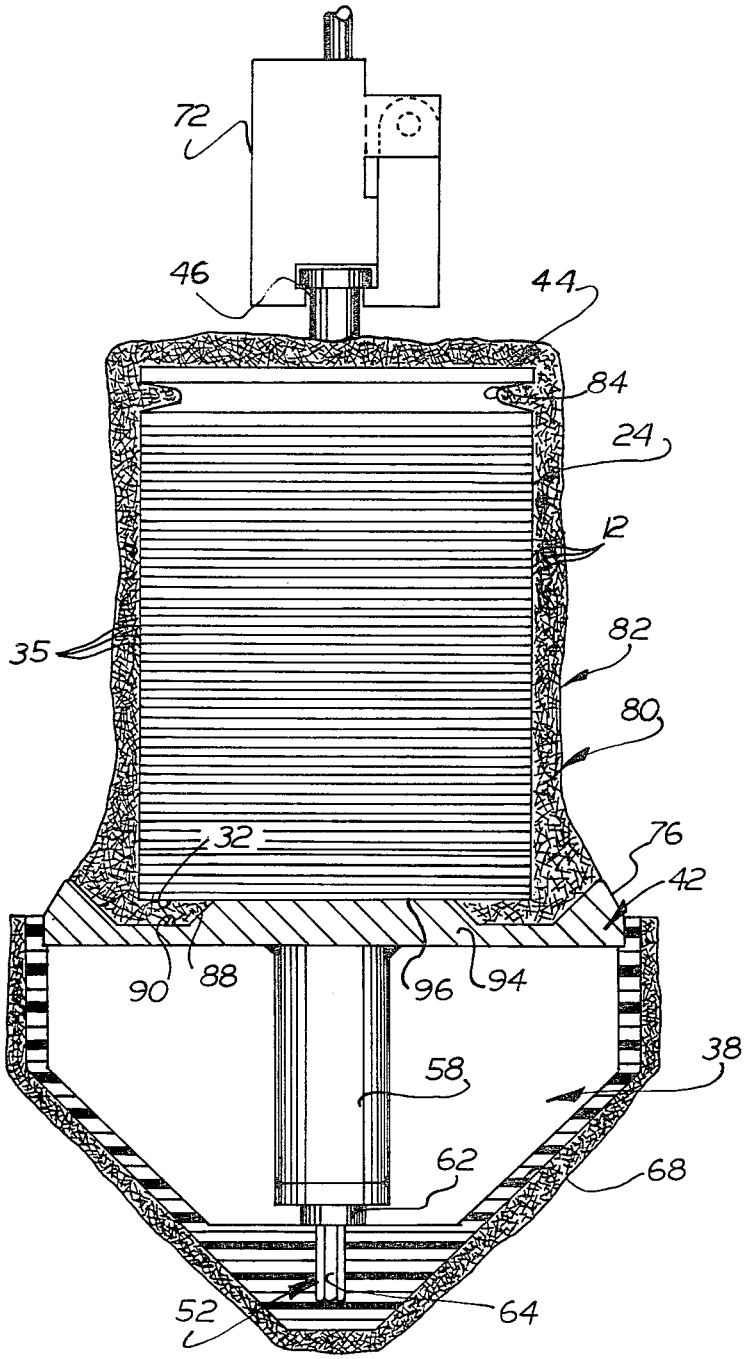
FIG. 5 is a partially broken-away view, generally similar to FIG. 4 and on a somewhat reduced scale, illustrating the manner in which the stack of mold sections is enclosed by a rigid ceramic casing.

Once the stack 24 of mold sections has been clamped between the top and bottom plates, a plastic snap-on cover 68 (see FIG. 5) is connected to the bottom clamp plate 42 to enclose the end of the clamp rod 52 and the spacer 58. The stem 46 is then engaged by a suitable handling mechanism 72. Since the stem 46 is disposed in threaded engagement with the top clamp plate 44 and since the top clamp plate 44 is connected with the bottom clamp plate 42 by the rod 52, the stack 24 of mold sections 12 is supported for movement by the clamp assembly 38.

The handling mechanism 72 is actuated to move the stack 24 of mold sections over a container (not shown) of liquid ceramic mold material. Although many different types of liquid ceramic mold material could be utilized, one illustrative slurry contains fused silica, zircon, or other refractory materials in combination with binders. Chemical binders such as ethyl silicate, sodium silicate and colloidal silica can be utilized. In addition, the slurry may contain suitable film formers such as alginates to control viscosity and wetting agents to control flow characteristics and wettability.

The handling mechanism 72 is actuated to immerse the stack 24 of mold sections 12 and clamp assembly 38 in the body of liquid ceramic mold material. The handling mechanism 72 is then raised to withdraw the stack 24 of mold sections 12 from the body of liquid ceramic material. This results in the entire stack 24 of mold sections and the clamp assembly 38 being enclosed by a coating of wet ceramic material. The wet coating of ceramic material directly overlies the exposed minor side surfaces 35 of the mold sections 12, the top clamp plate 44, the bottom clamp plate 42 and the cover 68.

To facilitate separating the cap 68 from the bottom clamp plate 42, the coating of wet ceramic material is wiped away from an annular outer rim surface 76 of the bottom clamp plate 42. This divides the wet coating of liquid ceramic mold material into two portions, that is a lower portion overlying the cover 68 and an upper portion overlying the stack 24 of mold sections.

It is contemplated that it may be necessary to at least partially dry this coating of wet ceramic material and to again dip the stack 24 of mold sections in the slurry of ceramic mold material. The dipping and drying steps are repeated until a covering 80 of ceramic mold material of a desired thickness has been built up over the stack 24 of mold sections 12 to form a mold 82. Each time the stack of mold sections is dipped, the surface 76 on the bottom clamp plate 42 is wiped to maintain a clear line of discontinuity between the portion of the ceramic covering overlying the stack 24 of mold sections and the cover 68.

As the stack 24 of mold sections 12 is repetitively dipped and dried in the slurry of ceramic mold material, an annular groove 84 in the upper clamp plate 44 is filled with ceramic mold material to interlock the upper clamp plate and the covering 80 of ceramic mold material. In addition, an annular cavity 88 (see FIG. 4) formed between a radially outer portion of a downwardly facing major side surface 32 of a lowermost mold section 12 in the stack 24 and a circular upwardly facing surface 90 of the bottom clamp plate 42 is filled with ceramic mold material (see FIG. 5). It should be noted that the ceramic mold material in the cavity 88 extends beneath the stack 24 of mold sections 12 and has a lower surface which is shaped to a desired configuration by the upwardly facing surface 90 of the bottom clamp plate 42. In order to support the stack 24 of mold sections 12 above the upwardly facing surface 90 of the bottom clamp plate 42, the bottom clamp plate has a raised circular central portion 94 with a flat surface 96 which is disposed in tight abutting engagement with the bottom major side surface 32 of the lowermost mold section 12 in the stack 24.

After a ceramic covering 80 of a desired thickness has been built up over the stack 24 of mold sections, the handling mechanism 72 is actuated to move the stack 24 of mold sections away from the container of liquid ceramic mold material. At this time, the covering 80 of ceramic mold material has been at least partially dried to form a rigid ceramic casing enclosing the mold sections 12.

The snap-on cover 68 is then pulled off the bottom clamp plate 42 to expose the lower portion of the clamp assembly 38. It should be noted that by wiping the surface 76 of the bottom clamp plate 42 after each of the dip coatings, a discontinuity is formed in the relatively hard ceramic covering 80. This discontinuity greatly facilitates separating the plastic cover 68 from the bottom clamp plate 42.

Figure 6:
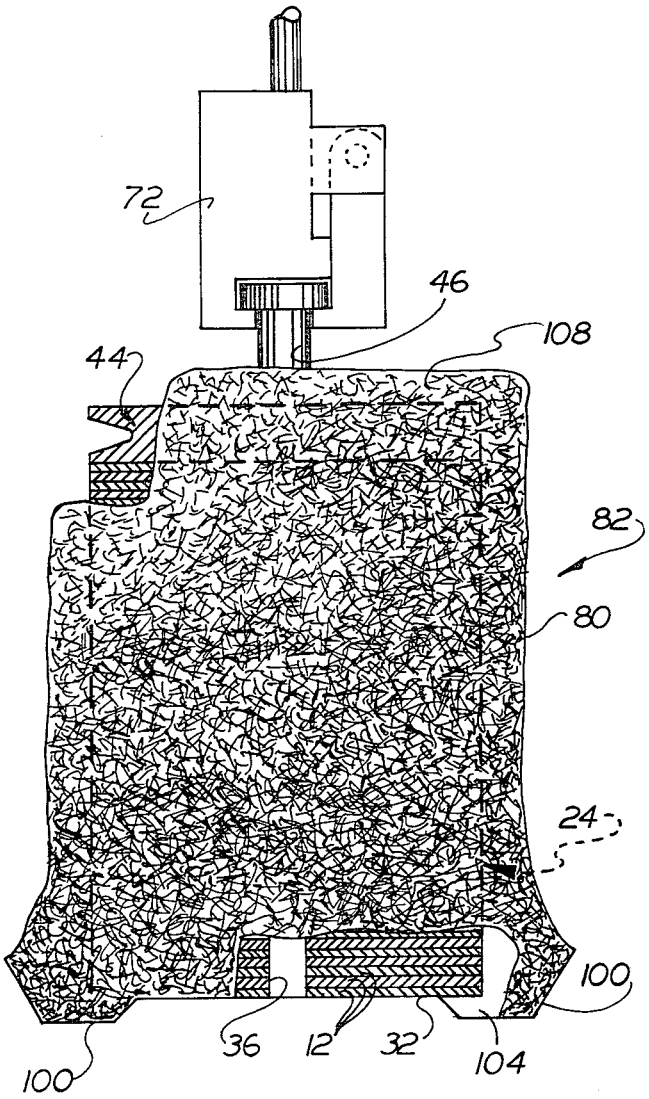
FIG. 6 is a partially broken-away sectional view illustrating the relationship between the stack of mold sections and the ceramic casing of FIG. 5 after the clamp assembly of FIG. 4 has been at least partially removed.

Once the cover 68 has been removed, the clamp rod 52 is rotated to disengage the threaded upper end portion of the clamp rod from the threaded opening 48 (see FIG. 4) in the top clamp plate 44. When the clamp rod 52 has been disengaged from the top clamp plate 44, both the bottom clamp plate 42 and the rod can be readily separated from the stack 24 of mold sections (see FIG. 6). Separating the bottom clamp plate 42 from the stack 24 of mold sections exposes an annular sealing surface 100 formed on a bottom portion of the mold 82. The sealing surface 100 was accurately shaped to the desired configuration by the upwardly facing surface of the bottom clamp plate 42.

It should be noted that at this time the stack 24 of mold sections is supported by an annular inwardly projecting lip 104 of the covering 80 of ceramic mold material. The rigid covering 80 of ceramic mold material is itself supported by the upper clamp plate 44 and the handling stem 106 which is engaged by the mechanism 72. To this end, the covering 80 has a circular end portion 108 which overlies the upper surface of the clamp plate 44 to provide support for the covering. Therefore, the relatively rigid ceramic covering 80 must have sufficient strength to support the stack 24 of mold sections.

In accordance with one feature of the present invention, the rigid ceramic covering 80 clampingly holds the mold sections 12 between the inwardly projecting annular lip 104 and the end portion 108 of the covering. This clamping pressure applied by the rigid ceramic covering 80 presses the major side surfaces 32 and 34 of the mold sections 12 into tight sealing engagement with each other. In addition, the rigid ceramic covering 80 holds the mold sections 12 against sidewise movement relative to each other. Since the mold sections 12 are clamped together and are held against both radial and axial movement relative to each other by the rigid ceramic covering 80, the mold cavities 14 can be filled with molten metal with a minimum of danger of a metal break-out between the mold sections.

Figure 7:
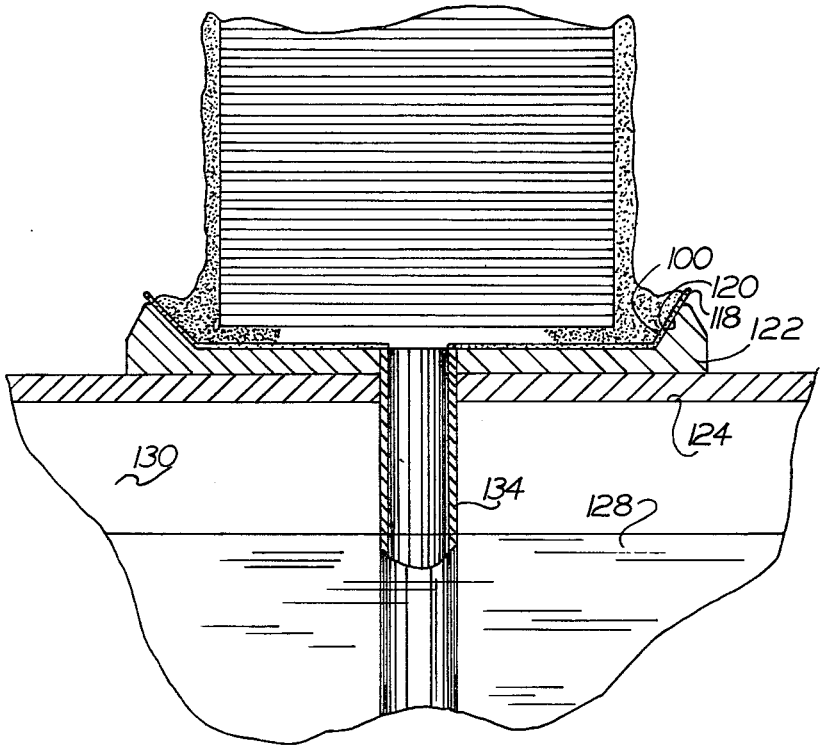
FIG. 7 is a fragmentary sectional view illustrating the relationship between the stack of mold sections, the ceramic casing and a container from which molten metal is forced upwardly under the influence of fluid pressure into mold cavities defined by the mold sections.

Although molten metal could be directed into the mold cavities 14 in many different ways, it is preferred to utilize a fluid pressure differential in a manner similar to that described in U.S. Pat. No. 3,900,064 to force the molten metal into the mold. When the mold 82 is filled in this manner, it may be first preheated in order to prevent chilling of the molten metal as it is introduced into the mold. The accurately formed sealing surface 100 on the preheated rigid ceramic covering 80 is then clamped against a gasket 118 on a support surface 120 (see FIG. 7) formed in a glazed ceramic member 122 connected with a top cover 124 of a container 126 of molten metal 128. The fluid pressure in a chamber enclosing the preheated mold 82 is then reduced. The relatively high fluid pressure in a chamber 130 in the container 126 of molten metal causes the molten metal to flow upwardly through a conduit 134 which extends downwardly into the body of molten metal. As the molten metal flows upwardly through the conduit 134 it enters the sprue passage 36 formed in the stack 24 of the mold sections 12 by the circular central openings 16 in the mold sections. As the molten metal rises in the sprue passage 36, it flows radially outwardly through the various runners 18 to the associated mold cavities 14.

In accordance with an important feature of the present invention, both the mold sections 12 and the rigid ceramic covering 80 are formed of a gas permeable material. Thus, the mold sections 12 are formed of sand, such as a CO2 sand, resin bonded sand or green sand. When the wet dip coating of ceramic mold material over the stack 24 of mold sections is dried, a covering 80 having an open interconnecting cellular construction is formed so that gas can readily flow through the covering 80. Therefore, as the molten metal flows into the mold cavities 14, gas can escape from the mold cavity through the mold sections 12 and through the rigid ceramic covering 80. To facilitate the flow of gas from the mold cavities, passages may be formed in the various mold sections 12. Since in the illustrated embodiment of the invention the mold cavities 14 have an annular construction to form piston rings, circular passages 138 are formed in the mold sections 12. Of course, when objects having a shape other than the annular configuration of the piston ring 10 are to be molded, passages having a different configuration could be located at a different location relative to the mold cavities. It should be understood that it is contemplated that the mold sections 12 and the rigid ceramic covering 80 could be formed of gas permeable materials other than the ones specifically set forth herein.

Once the molten metal has entered the mold cavities 14 and begun to solidify, the suction in the chamber enclosing the mold is eliminated. This results in an equalization of the fluid pressure between the cavity 130 inside the container 126 of molten metal and the mold. Therefore, the molten metal in the sprue passage 36 will flow back down through the conduit 134 to the container 126 to thereby tend to minimize the amount of metal utilized in forming the piston rings 10. It should be understood that rather than applying suction to the mold to draw the molten metal into the sprue passage 36 and mold cavities 14, fluid pressure could be introduced into the chamber 130 to urge the molten metal upwardly into the sprue passage 36 and mold cavities 14. In fact, it is contemplated that the molten metal could be introduced into the mold cavities 14 in many different ways, such as by merely pouring the molten metal into the sprue passage 36. Regardless of how the molten metal is introduced into the mold cavities 14, the rigid ceramic covering 80 holds the mold sections in tight engagement with each other to prevent a break-out of molten metal between the mold sections.

After the molten metal in the mold cavities 14 has solidified, the ceramic covering 80 and the mold sections 12 are destroyed. This releases the piston rings 10 formed in the various mold cavities 14. It should be noted that since the sprue passage 36 was emptied of molten metal, there is no interconnecting waste metal between the various piston rings. Of course, this greatly facilitates the final finishing of the piston rings. Although it is believed that the mold disclosed herein is particularly advantageous in forming piston rings, it is contemplated that it could be utilized to form other relatively small objects. It should also be understood that although each mold section 12 has been disclosed herein as providing a plurality of mold cavities, each mold section could be utilized to provide only a single mold cavity. In fact, a plurality of mold sections could cooperate with each other to define a single mold cavity.

In view of the foregoing description, it can be seen that the present invention provides a new and improved mold 82 which is formed by applying a wet coating of liquid ceramic mold material over a plurality of mold sections 12. The wet coating of liquid ceramic mold material is dried to form a rigid casing 80 which encloses the mold sections 12. This rigid ceramic casing 80 holds the mold sections 12 against movement relative to each other during a molding operation in which molten metal is directed into one or more cavities 14 defined by the mold sections.

Since the wet coating of liquid ceramic mold material will conform to the configuration of the outside surfaces of the mold sections 12, the dimensions of the mold sections can vary due to manufacturing tolerances. Even if both the width and thickness of the mold sections 12 vary somewhat relative to each other, the wet coating of ceramic mold material will conform to the configuration of the outside of the mold sections so that the resulting rigid ceramic casing 80 will hold the mold sections 12 in sealing abutting engagement with each other to prevent a break-out of molten metal between the mold sections during a casting operation. The rigid ceramic casing 80 and the mold sections 12 are both gas permeable. This enables gas to readily escape from the mold 82 during a casting operation.

Prior to being covered with a ceramic material, the mold sections 12 are advantageously clamped together in a stack 24 by means of a pair of clamp members 42 and 44 disposed at opposite ends of the stack. The clamp members 42 and 44 are interconnected by a rod 52 which extends through a sprue passage 36 formed in the stack 24. This clamping arrangement holds the mold sections 12 against movement relative to each other during the application of the coating of liquid ceramic material to the mold sections and during the subsequent drying of the coating. After the coating has been dried, the clamp member 52 extending through the central passage 36 in the stack 24 of mold sections is withdrawn to provide an open passage for the flow of metal into the mold. Although it is contemplated that a flow of metal may be induced into the mold in many different ways, the metal is advantageously forced into the mold under the influence of a fluid pressure differential.

I claim:

1. A method comprising the steps of providing a plurality of mold sections which at least partially define at least one mold cavity, applying a wet coating of liquid ceramic material over the mold sections, retaining the mold sections against movement relative to each other during said step of applying a wet coating of ceramic material over the mold sections by clamping the mold sections between a pair of rigid members, forming a rigid casing at least partially enclosing the mold sections by drying the wet coating of ceramic material, moving at least one of the rigid members away from a clamping position engaging at least one of the mold sections to a disengaged position spaced apart from the mold sections after performing said step of drying the wet coating of ceramic material, sealingly engaging a surface of the rigid casing of ceramic material which was exposed by said step of moving the one rigid member with a molten metal dispensing assembly, flowing molten metal from the molten metal dispensing assembly into a mold cavity which is at least partially defined by the mold sections, and holding the mold sections against movement relative to each other with the rigid casing of ceramic material during said step of flowing molten metal into the mold cavity, said step of flowing molten metal into the mold cavity including the step of flowing the molten metal from the molten metal dispensing assembly along a path extending through the ceramic casing surface exposed by moving the one rigid member.

2. A method as set forth in claim 1 wherein said step of providing a plurality of mold sections includes the step of providing a plurality of gas permeable mold sections, said step of forming a rigid casing including the step of forming a gas permeable casing of ceramic material, said method further including the step of flowing gas from the mold cavity through the gas permeable mold sections and casing during said step of flowing molten metal into the mold cavity.

3. A method as set forth in claim 1 wherein said step of applying a wet coating of liquid ceramic material over the mold sections includes the step of dipping the mold sections in a body of liquid ceramic material.

4. A method as set forth in claim 1 wherein said step of providing a plurality of mold sections includes the step of providing a plurality of mold sections having a pair of spaced apart major side surfaces interconnected by a minor side surface, said method further including the step of stacking the mold sections with the major side surfaces of the mold sections in abutting engagement and with the minor side surfaces of the mold sections exposed, said step of clamping the mold sections including the step of clamping the stack of mold sections between the pair of rigid members, said step of applying a wet coating of liquid ceramic material over the mold sections including the step of applying liquid ceramic material over the exposed minor side surfaces of the stack of mold sections.

5. A method as set forth in claim 4 wherein said step of providing a plurality of mold sections further includes the step of providing a plurality of mold sections which at least partially define a plurality of mold cavities, each of the mold sections having a passage extending between the major side surfaces of the mold sections, said step of stacking the mold sections including the step of stacking the mold sections with the passages in the mold sections in alignment to form a passage extending through the stack of mold sections, each of the plurality of mold cavities being connected in fluid communication with the passage extending through the stack of mold sections by channels defined by surfaces of the mold sections, said step of flowing molten metal into the mold cavities including the steps of flowing molten metal into the passage extending through the stack of mold sections and flowing molten metal from the passage through the channels to the mold cavities.

6. A method as set forth in claim 5 wherein said step of applying a clamping force to the stack of mold sections includes the step of transmitting force between opposite end portions of the stack of mold sections by means of a member disposed in the passage extending through the stack of mold sections.

7. A method as set forth in claim 6 further including the step of removing the member from the passage extending through the stack of mold sections after performing said step of drying the wet coating of ceramic material and prior to performing said step of flowing molten metal into the mold cavity.

8. A method comprising the steps of providing a plurality of mold sections which at least partially define a plurality of mold cavities, said step of providing a plurality of mold sections includes the step of providing a plurality of mold sections having a pair of spaced apart major side surfaces interconnected by a minor side surface, each of said mold sections having a passage extending between the major side surfaces of the mold sections, said method further including the step of stacking the mold sections with the major side surfaces of the mold sections in abutting engagement and with the minor side surfaces of the mold sections exposed, said step of stacking the mold sections includes the step of stacking the mold sections with the passages in the mold sections in alignment to form a passage extending through the stack of mold sections, each of the plurality of mold cavities being connected in fluid communication with the passage extending through the stack of mold sections by channels defined by surfaces of the mold sections, applying a wet coating of liquid ceramic material over the mold sections, said step of applying a wet coating of liquid ceramic material over the mold sections including the step of applying liquid ceramic material over the exposed minor side surfaces of the stack of mold sections, applying a clamping force to the stack of mold sections to hold them against movement during said step of applying a wet coating of liquid ceramic material over the mold sections, said step of applying a clamping force to the stack of mold sections including the step of transmitting force between opposite end portions of the stack of mold sections by means of a member disposed in the passage extending through the stack of mold sections, forming a rigid casing at least partially enclosing the mold sections by drying the wet coating of ceramic material, flowing molten metal into the mold cavities which are at least partially defined by the mold sections, and holding the mold sections against movement relative to each other with the rigid casing of ceramic material during said step of flowing molten metal into the mold cavity, removing the member from the passage extending through the stack of mold sections after performing said step of drying the wet coating of ceramic material and prior to performing said step of flowing molten metal into the mold cavities, said step of flowing molten metal into the mold cavities including the steps of flowing molten metal into the passage extending through the stack of mold sections and flowing molten metal from the passage through the channels to the mold cavities.

9. A method as set forth in claim 8 wherein said step of providing a plurality of mold sections includes the step of providing a plurality of gas permeable mold sections, said step of forming a rigid casing including the step of forming a gas permeable casing of ceramic material, said method further including the step of flowing gas from the mold cavity through the gas permeable mold sections and casing during said step of flowing molten metal into the mold cavity.

10. A method comprising the steps of providing a plurality of mold sections which at least partially define at least one mold cavity, placing the mold sections on a support member with a first portion of an outer surface of one of the mold sections in abutting engagement with the support member and a second portion of the outer surface of the one mold section spaced apart from a surface area of the support member to at least partially define a secondary cavity between the second portion of the outer surface of the one mold section and the surface area of the support member, applying a wet coating of liquid ceramic material over the mold sections, said step of applying a wet coating of liquid ceramic material over the mold sections including the step of at least partially filling the secondary cavity with wet ceramic material, forming a rigid casing at least partially enclosing the mold sections by drying the wet coating of ceramic material, said step of drying the wet coating of ceramic material including the step of drying the ceramic material in the secondary cavity, flowing molten metal into the mold cavity which is at least partially defined by the mold sections, and holding the mold sections against movement relative to each other with the rigid casing of ceramic material during said step of flowing molten metal into the mold cavity.

11. A method as set forth in claim 10 wherein said step of holding the mold sections against movement relative to each other includes the step of urging the molding sections into tight abutting engagement with each other by applying a clamping force to the mold sections with the rigid casing.

12. A method as set forth in claim 10 wherein said step of providing a plurality of mold sections includes the step of providing a plurality of gas permeable mold sections, said step of forming a rigid casing including the step of forming a gas permeable casing of ceramic material, said method further including the step of flowing gas from the mold cavity through the gas permeable mold sections and casing during said step of flowing molten metal into the mold cavity.

13. A method as set forth in claim 10 further including the step of supporting the mold sections on the support member during said steps of applying a wet coating of liquid ceramic material over the mold sections and drying the wet coating of ceramic material, said method further including the step of applying a wet coating of liquid ceramic material over at least a portion of the support member while performing said step of applying a wet coating of liquid ceramic material over the mold sections, and removing at least a major portion of the wet coating of ceramic material overlying a surface area of the support member to separate the coating of wet ceramic material into at least two portions one of which overlies the mold sections and the other of which is spaced apart from the mold sections.

14. A method as set forth in claim 10 wherein said step of applying a wet coating of liquid ceramic material over the mold sections includes the step of dipping the mold sections in a body of liquid ceramic material.

15. A method as set forth in claim 10 further including the step of retaining the mold sections against movement relative to each other during said step of applying a wet coating of ceramic material over the mold sections by clamping the mold sections between the support member and a rigid member.

16. A method as set forth in claim 10 further including the step of moving the support member away from the mold sections to a disengaged position spaced apart from the mold sections after performing said step of drying the wet coating of ceramic material.

17. A method as set forth in claim 10 wherein said step of providing a plurality of mold sections includes the step of providing a plurality of mold sections having a pair of spaced apart major side surfaces interconnected by a minor side surface, said method further including the step of stacking the mold sections with the major side surfaces of the mold sections in abutting engagement with the minor side surfaces of the mold sections exposed and with the secondary cavity at one end of the stack of mold sections, said step of applying a wet coating of liquid ceramic material over the mold sections including the step of applying liquid ceramic mold material over the exposed minor side surfaces of the stack of mold sections.

18. A method as set forth in claim 10 wherein said step of providing a plurality of mold sections further includes the step of providing a plurality of mold sections which at least partially define a plurality of mold cavities, each of the mold sections having a passage extending between the major side surfaces of the mold sections, said step of stacking the mold sections including the step of stacking the mold sections with the passages in the mold sections in alignment to form a passage extending through the stack of mold sections, each of the plurality of mold cavities being connected in fluid communication with the passage extending through the stack of mold sections by channels defined by surfaces of the mold sections, said step of flowing molten metal into the mold cavities including the steps of flowing molten metal into the passage extending through the stack of mold sections and flowing molten metal from the passage through the channels to the mold cavities.

19. A method as set forth in claim 18 further including the step of applying a clamping force to the stack of mold sections to hold them against movement during said step of applying a wet coating of liquid ceramic material over the mold sections, said step of applying a clamping force to the stack of mold sections including the step of transmitting force between opposite end portions of the stack of mold sections by means of a member connected with the support member and disposed in the passage extending through the stack of mold sections.

20. A method as set forth in claim 19 further including the step of removing the member from the passage extending through the stack of mold sections after performing said step of drying the wet coating of ceramic material and prior to performing said step of flowing molten metal into the mold cavity.

21. A method as set forth in claim 10 further including the step of placing the mold sections on the support member in a stack having side portions extending between opposite end portions of the stack, said step of applying a wet coating of liquid ceramic material over the mold sections includes the step of at least partially enclosing the side and opposite end portions of the stack of mold sections with a wet coating of liquid ceramic material.

22. A method as set forth in claim 21 wherein said step of holding the mold sections against movement relative to each other includes the step of applying a clamping force to the stack of mold sections with the rigid casing.

23. A method as set forth in claim 21 wherein said step of applying a wet coating of liquid ceramic material over the mold sections includes the step of dipping the stack of mold sections in a body of liquid ceramic material.

24. A method as set forth in claim 10 further including the step of separating the support member from the mold sections after performing said step of drying the ceramic material in the secondary cavity to expose a rigid ceramic surface having a configuration corresponding to the configuration of the surface area of the support member.

25. A method as set forth in claim 24 further including the step of sealingly engaging the rigid ceramic surface having a configuration corresponding to the surface area of the support member prior to performing said step of flowing molten metal into the mold cavity, said step of flowing molten metal into the mold cavity including the step of flowing molten metal along path which is circumscribed by the rigid ceramic surface having a configuration corresponding to the surface area of the support member.

26. A method comprsing the steps of providing a plurality of mold sections which at least partially define at least one mold cavity, placing the mold sections in a stack having side portions extending between opposite end portions of the stack, engaging opposite end portions of the stack of mold sections with a pair of clamp members and urging the clamp members toward each other to apply a clamping force to the stack of mold sections, applying a wet coating of liquid ceramic material over the mold sections, said step of applying a wet coating of liquid ceramic material over the mold sections includes the step of at least partially enclosing the pair of clamp members and the side and opposite end portions of the stack of mold sections with a wet coating of liquid ceramic material, forming a rigid casing at least partially enclosing the mold sections by drying the wet coating of ceramic material, maintaining the clamping force on the stack of mold sections during said step of drying the wet coating of ceramic material, flowing molten metal into the mold cavity which is at least partially defined by the mold sections, holding the mold sections against movement relative to each other with the rigid casing of ceramic material during said step of flowing molten metal into the mold cavity, and maintaining at least one of said clamp members in engagement with the stack of mold sections during said step of flowing molten metal into the mold cavity.

27. A method as set forth in claim 26 wherein said step of holding the mold sections against movement relative to each other includes the step of urging the mold sections into tight abutting engagement with each other by applying a clamping force to the mold sections with the rigid casing.

28. A method as set forth in claim 26 wherein said step of providing a plurality of mold sections includes the step of providing a plurality of gas permeable mold sections, said step of forming a rigid casing including the step of forming a gas permeable casing of ceramic material, said method further including the step of flowing gas from the mold cavity through the gas permeable mold sections and casing during said step of flowing molten metal into the mold cavity.

* * * * *

UNITED STATES PATENT AND TRADEMARK OFFICE

CERTIFICATE OF CORRECTION

PATENT NO. : 4,367,782

DATED : January 11, 1983

INVENTOR(S) : Gustav E. Schrader

It is certified that error appears in the above-identified patent and that said Letters Patent are hereby corrected as shown below:

Column 11, line 4, change "molding" to --mold--.

Signed and Sealed this

*Twelfth* Day of *April 1983*

[SEAL]

*Attest:*

GERALD J. MOSSINGHOFF

*Attesting Officer*

*Commissioner of Patents and Trademarks*